US010871044B2

(12) United States Patent
Fischer

(10) Patent No.: US 10,871,044 B2
(45) Date of Patent: Dec. 22, 2020

(54) SYSTEM AND METHOD FOR PROVIDING DRILLING FLUID FOR EARTH DRILLING

(71) Applicant: TRACTO-TECHNIK GMBH & CO. KG, Lennestadt (DE)

(72) Inventor: Sebastian Fischer, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 16/469,227

(22) PCT Filed: Dec. 21, 2017

(86) PCT No.: PCT/EP2017/084190
§ 371 (c)(1),
(2) Date: Jun. 13, 2019

(87) PCT Pub. No.: WO2018/115336
PCT Pub. Date: Jun. 28, 2018

(65) Prior Publication Data

US 2020/0102799 A1 Apr. 2, 2020

(30) Foreign Application Priority Data

Dec. 22, 2016 (DE) ..... 10 2016 015 399

(51) Int. Cl.
*E21B 21/06* (2006.01)
*B01F 15/00* (2006.01)
(Continued)

(52) U.S. Cl.
CPC ..... *E21B 21/062* (2013.01); *B01F 15/00207* (2013.01); *B01F 15/00266* (2013.01);
(Continued)

(58) Field of Classification Search
None
See application file for complete search history.

(56) References Cited

U.S. PATENT DOCUMENTS

2002/0125046 A1* 9/2002 Schauerte ..... B01F 3/1214 175/57
2007/0084638 A1* 4/2007 Bohnsack ..... E21B 21/01 175/66

(Continued)

FOREIGN PATENT DOCUMENTS

DE 19745766 A1 4/1998
DE 102015115182 A1 3/2017

OTHER PUBLICATIONS

International Search report for PCT/EP2017/084190; dated Mar. 3, 2018.

*Primary Examiner* — Andrew Sue-Ako
(74) *Attorney, Agent, or Firm* — Howard IP Law Group, PC

(57) ABSTRACT

It is described how to provide a drilling fluid for earth drilling, wherein the drilling fluid comprises a liquid and at least one mineral. A recycling device preconditions supplied drilling fluid. At least one drilling fluid analyzer is provided for determining the state of drilling fluid that comes out of the borehole. There is also a mixing device for mixing drilling fluid reconditioned by the recycling device with liquid and/or mineral, wherein the mixing device is coupled to the drilling fluid analyzer in order to perform mixing according to the state of the drilling fluid.

16 Claims, 1 Drawing Sheet

(51) Int. Cl.
*B01F 15/04* (2006.01)
*E21B 21/01* (2006.01)

(52) U.S. Cl.
CPC .. *B01F 15/0408* (2013.01); *B01F 2215/0081* (2013.01); *E21B 21/01* (2013.01)

(56) References Cited

U.S. PATENT DOCUMENTS

| | | | |
|---|---|---|---|
| 2014/0328137 | A1 | 11/2014 | Lauder et al. |
| 2016/0024367 | A1 | 1/2016 | Zha et al. |
| 2016/0047485 | A1 | 2/2016 | Waller |

* cited by examiner

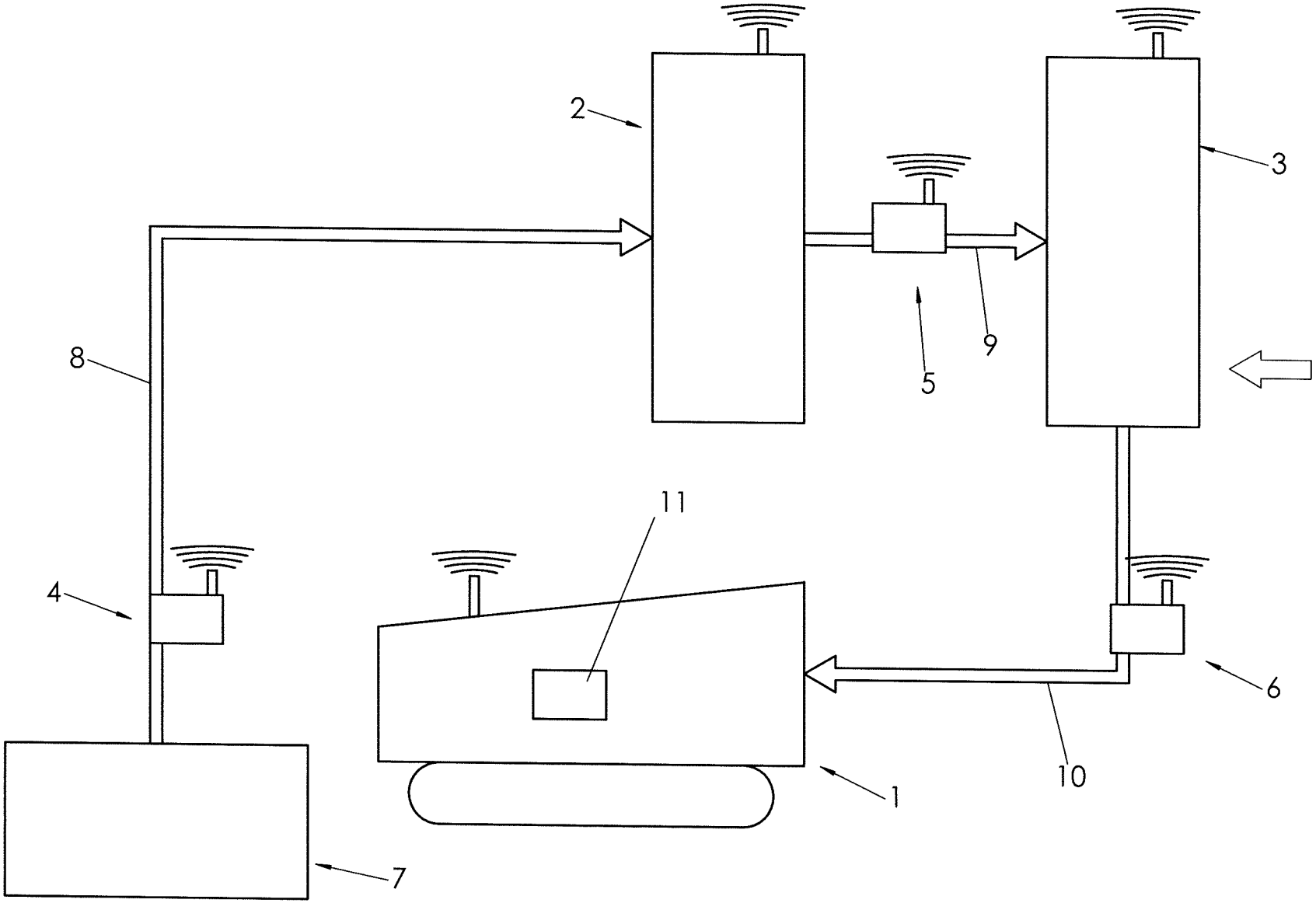
3
6
10
9
5
1
2
11
7
8
4

SYSTEM AND METHOD FOR PROVIDING DRILLING FLUID FOR EARTH DRILLING

CROSS-REFERENCE TO RELATED APPLICATIONS

This application is the national stage application under 35 U.S.C. § 371 of International Application No. PCT/EP2017/084190 filed on 21 Dec. 2017, and claims the benefit of DE 10 2016 015 399.7 filed on 22 Dec. 2016, the entire disclosures of which are incorporated herein by reference in their entireties.

The invention relates to a system and a method for providing drilling fluid for earth drilling as well as a use of a drilling fluid analyzer when providing the drilling fluid for the earth drilling.

In the creation of earth boreholes and especially horizontal boreholes, it is known how to use a drilling fluid to support the advancement of the boring. The drilling fluid can be used to soften the soil lying in front of the drilling head of the drilling device and thereby improve the cutting effect of the drilling head. Furthermore, the drilling fluid may serve to lubricate the drilling head as well as the drill string driven in rotation in the borehole and consequently to lessen the friction with the soil. In addition, the drilling fluid can be used to flush the soil loosened by the drilling head through the annular gap between the drill string and the borehole wall or through an annular gap of a double drill string, which may comprise an inner tubing and an outer tubing.

The drilling fluid used is generally a mixture of water and a mineral, especially bentonite, and possibly several additives, which may also be minerals. Bentonite is a mixture of various clay minerals, the largest ingredient being montmorillonite (generally with a fraction of 60% to 80%). Other accompanying minerals may be quartz, mica, feldspar, pyrites, and also calcite in part. Because of the montmorillonite content, bentonite has a strong water uptake and swelling capacity.

Water into which a mineral is stirred, especially bentonite, may have thixotropic behavior, so that it may behave essentially like a liquid when in movement, but on the other hand like a solid structure when at rest. Because of this property, a drilling fluid consisting of water and a mineral, especially bentonite, may also be used to brace the wall of the borehole, so that a collapsing can be prevented.

The drilling fluid is generally mixed in advance and kept in large tanks at the site of use, generally using tanks with a capacity of around 10,000 liters. Moreover, it is known that the drilling fluid flushed out from the borehole is manually tested and reconditioned by a separate recycling unit. A person assigned this task must determine the condition of the drilling fluid and make settings at the recycling unit in order to reuse the drilling fluid coming from the borehole for the drilling once more. The drawback is that, owing to different drilling conditions during the making of a borehole, changes may result in the fluid coming from the borehole and the person assigned with this task is occupied with constantly monitoring the condition of the drilling fluid and adjusting the recycling unit appropriately. In this way, the advancement can be shortened or the time for the borehole being made can be increased.

The problem which the invention proposes to solve is therefore to provide an improved system for providing drilling fluid for earth drilling as well as a use of a system for providing of drilling fluid for earth drilling which can make possible a faster production of the earth borehole and/or which is more user-friendly.

The problem is solved by the subject matter of the coordinated patent claims. Advantageous modifications are the subject matter of the dependent patent claims and they will emerge from the following specification.

The key notion of the invention is to send the drilling fluid coming from the borehole to a drilling fluid analyzer to determine the condition of the drilling fluid, especially on the way to the recycling device, and to provide a mixing device for the mixing of drilling fluid reconditioned by the recycling device with liquid and/or a mineral or minerals, wherein the mixing device is coupled to the drilling fluid analyzer so as to perform the mixing according to the condition of the drilling fluid. In this way, an automated or self-regulating system can be created for the providing of drilling fluid for the earth drilling, in which at least one metering station is provided in the form of the drilling fluid analyzer, which is hooked up in the fluid path for the drilling fluid coming from the borehole, in order to ascertain the condition of the drilling fluid. The coupling between the drilling fluid analyzer and the mixing device can thus occur without the involvement of the user. The coupling may be regarded as a communication, which can be unidirectional or bidirectional. The drilling fluid analyzer can relay the ascertained condition of the drilling fluid to the mixing device by means of a signal sent to the mixing device, the mixing device for its part sending a signal to the drilling fluid analyzer in order to relay the settings to be made at the mixing device for the mixing of the reconditioned drilling fluid with liquid and/or a mineral or minerals. No adjustment by the user is needed between the condition of the drilling fluid coming from the borehole and a mixing device which mixes the spent drilling fluid with liquid and/or a mineral or minerals. No person needs to be present for the current condition of the drilling fluid or the mixing or recycling of the spent drilling fluid. A setpoint may be used for the drilling fluid which is to be used for the drilling—i.e., how it enters into the soil from the ground drilling device or enters into the ground drilling device. The key notion of the invention not only enables an automation of the process, but also the constant monitoring of the drilling fluid can reduce the quantity of drilling fluid prepared in advance. Furthermore, the time used to create the earth borehole can be reduced.

The invention creates a system for providing a drilling fluid for earth drilling, wherein the drilling fluid comprises a liquid and at least one mineral. The system comprises a recycling device for preconditioning of supplied drilling fluid. Moreover, the system comprises at least one drilling fluid analyzer for determining the state of drilling fluid that comes out of the borehole. The system furthermore comprises a mixing device for mixing drilling fluid reconditioned by the recycling device with liquid and/or mineral. The mixing device is coupled to the drilling fluid analyzer in order to perform mixing according to the state of the drilling fluid.

The term "drilling fluid" in the sense of the invention is a mixture of a liquid, especially water, and at least one mineral, especially bentonite, and possibly one or more additives, which may be a liquid and/or a solid. The term "drilling fluid" does not preclude a gaseous fraction.

The term "earth drilling" in the sense of the invention encompasses a process which is carried out by a ground drilling device, wherein a ground drilling device is understood as being in particular any device which moves a drill string having drill rod segments in an existing channel in the soil or one being created in order to create or widen a borehole, especially a horizontal borehole (HD), or to pull conduits or other long bodies into the soil. The ground drilling device may be in particular an HD device. A ground drilling device comprises a device advancing a drill string, working by displacing earth, and the drill string is introduced by rotation and/or translation in the longitudinally axial direction of the drill string into the earth.

The term "HD" (horizontal drilling) in the sense of the present invention encompasses in particular every type of existing or yet to be created channels, preferably horizontal channels in a body, especially earth channels, including earth boreholes, rock boreholes, or earth conduits, as well as underground or aboveground pipelines and water canals which can be produced or laid by the use of a corresponding ground drilling device.

The term "at least one" used in the patent claims or in the specification, as well as the indefinite article "a(n)" used in the patent claims or in the specification—including its corresponding grammatical inflections—encompasses in regard to the following noun precisely one or more, i.e., two, three, four, and so forth, of the elements denominated by the noun.

A "recycling device" in the sense of the invention is a device which reconditions the drilling fluid coming from the borehole, i.e., already used for the drilling. By a reconditioning is meant the separation of the (dirty) drilling fluid coming from the borehole into its components, wherein a component may serve for mixing of drilling fluid to be used for the drilling. Basically, the recycling device can provide a recovery of drilling fluid to be used again for the drilling. The methods for reconditioning of the drilling fluid encompass a mechanical filtering, a chemical separation and/or a rejecting of portions of the drilling fluid coming from the borehole, which is to be taken once more to a mixing device for the mixing of drilling fluid.

A "drilling fluid analyzer" is a technical device which can determine the state of the drilling fluid. A drilling fluid analyzer in particular can ascertain the density, the viscosity, the sand content, the chemical composition and/or other physical and/or chemical quantities which can provide an indication of the possibility of using the drilling fluid for the earth drilling or for creating an earth borehole. In particular, a sensor or transducer of the drilling fluid analyzer may be arranged in a conduit or channel or fluid path for the conveying of the drilling fluid.

The term "mixing device" in the sense of the invention encompasses a device in which the drilling fluid reconditioned by the recycling device can be mixed with liquid and/or a mineral or minerals. The mixing device therefore comprises a fluid path for the supplying of drilling fluid reconditioned by the recycling device and a fluid feed path which can be loaded with liquid. Moreover, one or more minerals can be supplied via said fluid feed path. One or more fluid feed paths—separate from the fluid feed path for the liquid—may also be provided for the supplying of the mineral or several minerals. The fluid feed paths for the reconditioned drilling fluid, the liquid, and/or the mineral or the minerals can be mixed in a mixing channel and/or a mixing chamber. The amount of reconditioned drilling fluid, liquid, and/or mineral or minerals can be set, which may occur for example by flow regulating means, such as valves in particular.

When it is stated that the mixing device is coupled to the drilling fluid analyzer in order to mix the reconditioned drilling fluid with liquid and/or mineral or minerals according to the state of the drilling fluid, this shall be understood to mean according to the invention that a signal put out by the drilling fluid analyzer is used by the mixing device to set a condition for a mixing of the drilling fluid used for the earth drilling. A drilling fluid analyzer provides an actual value in regard to the condition of the drilling fluid. The volume relations of the reconditioned drilling fluid, the liquid and/or the mineral or the minerals may be adapted to the condition of the reconditioned drilling fluid in order to achieve a target condition of the drilling fluid used for the earth drilling. In particular, it may be provided that the drilling fluid analyzer is used to ascertain the condition of the drilling fluid emerging from the boring or the borehole (actual condition). The drilling fluid flowing or coming from the boring may be the drilling fluid coming directly from the boring or the reconditioned drilling fluid. Accordingly, the main point is that the drilling fluid coming from the borehole has already been used once and therefore may be laden with drill cuttings or soil. It is possible to ascertain not only the condition of the drilling fluid, but also the nature of the soil in which the borehole has been produced. The target condition of the drilling fluid can be set according to the soil so determined, which can be determined from the condition of the drilling fluid. Thus, it is possible not only to set a target condition of a drilling fluid, but also to adjust the condition of the drilling fluid to the particular soil in which the drilling head of the ground drilling device finds itself. In this way, the entire process of the mixing and the recycling can be fully automated. The nature of the soil can also be ascertained on the basis of parameters of the ground drilling device such as have been set, and the ground drilling device can request a target condition.

In one preferred embodiment, the system comprises a control unit, which is coupled to the drilling fluid analyzer and with which the mixing device can be actuated to provide a particular condition (target condition). The control unit may be part of the mixing device. It may also be provided that the control unit is independent of the mixing device. The control unit may also be designed as part of the drilling fluid analyzer. The control unit in particular may be designed as a controller or as computer hardware. The control unit may also be an integrated circuit or a microcontroller. The control unit may also be implemented in the form of a field programmable gate array (FPGA). The control unit may have a program or a logic circuit. With the program, time sequences of the control unit or the controller can be realized. With the logic circuit, which is intended in particular for the FPGA, a functional structure can be defined. A signal of a drilling fluid analyzer can be relayed to the mixing device in order to set the volumetric relations of the reconditioned drilling fluid, the supplied liquid and/or the mineral or minerals at the target condition. By means of the control unit, an individual response is possible to particular conditions of the drilling fluid, especially as it emerges from the borehole. For example, a mixing can be adapted by means of an adapted program and/or a table saved in memory, in which a condition as ascertained by the drilling fluid analyzer is matched up with a setpoint value of valves of the mixing device. For example, it is possible to use for different ground drilling devices a program adapted to the target condition and/or a table for the matching up of setpoints of the valves of the mixing device, wherein the setpoint of the valves results or can be calculated from the actual condition and the target condition—without the use of a table. In this way, in particular, a providing of drilling fluid adapted to ground, various impurities of drilling fluids, and/or different kinds of ground drilling devices can be achieved.

In one preferred embodiment, the system comprises a conduit which connects the boring or the borehole to the recycling device, a sensor of a drilling fluid analyzer being arranged in the conduit. In this way, the drilling fluid used during the drilling can be checked for its condition directly between the borehole and the recycling unit. The condition ascertained for the drilling fluid can be used for the reconditioning of the drilling fluid in the recycling device, in order to set the recycling device at the condition of the drilling fluid that needs to be reconditioned. In this way, the recycling device can carry out the exact methods needed to recondition the drilling fluid coming from the borehole. For example, when the drilling fluid is not very dirty or little laden with drill cuttings, an appropriate method can be carried out in the recycling device and/or the drilling fluid may even bypass the reconditioning. The drilling fluid analyzer which is arranged in the conduit between the borehole and the recycling device is therefore coupled in particular with the recycling device. The actuating unit of the recycling device with a signal of a drilling fluid analyzer that is received by a control unit of the recycling device offers the benefit that the recycling can also occur according to the condition of the drilling fluid. The method is further improved.

The coupling of the recycling device with the drilling fluid analyzer, situated in the conduit connecting the borehole and the recycling device, may be wireline or wireless. The coupling or the communication of the drilling fluid analyzer with the recycling device can be unidirectional or bidirectional.

In one preferred embodiment, a conduit is provided in the system which connects the recycling device and the mixing device, a sensor of a drilling fluid analyzer being situated in the conduit between recycling device and mixing device. The drilling fluid analyzer may actuate the mixing device in particular according to the condition of the drilling fluid. The drilling fluid analyzer can send a signal to the mixing device in particular. It may be provided that the communication between the drilling fluid analyzer and the mixing device is unidirectional or bidirectional. In this way, a direct coupling can be achieved. The mixing device can relay the settings to the drilling fluid analyzer so that the drilling fluid analyzer does not need to send a signal to a control unit, for example, when no changes need to be made in the settings of the mixing device.

The coupling of the recycling device, mixing device and one or more drilling fluid analyzers among each other can be wireless, so that a communication can be chosen which is independent of a permanently installed medium. A flexibility can be achieved, even over long length, without having to lay a conduit.

In one preferred embodiment, more than one drilling fluid analyzer is provided. The sensor or the drilling fluid analyzer associated with the sensor may be provided at or in a conduit, leading in particular from the borehole to the recycling device. Yet another drilling fluid analyzer can be provided in a conduit between the recycling device and the mixing device.

A further drilling fluid analyzer can be provided in a conduit between the mixing device and the ground drilling device.

In one especially preferred embodiment, the system also comprises the ground drilling device, which can be coupled with one or more drilling fluid analyzers, the recycling device and/or the mixing device. The coupling may be unidirectional or bidirectional. For example, the ground drilling device may request a different target condition of the drilling fluid, so that the recycling device and/or the mixing device can be actuated together with the signal of at least one of the drilling fluid analyzers, in order to produce a particular condition of the drilling fluid.

In a most especially preferred embodiment, the ground drilling device, the drilling fluid analyzer, the recycling device and the mixing device may communicate wirelessly with each other. In at least one of the aforementioned units or devices, the control unit may be provided. In the especially preferred embodiment, drilling fluid analyzers are provided, which ascertain the condition of the drilling fluid as it emerges from the borehole, the condition of the drilling fluid as it emerges from the recycling device, and the condition of the drilling fluid as it emerges from the mixing device. Most especially preferably, the control unit may be configured in or on the ground drilling device. A continuous comparison can be done for the actual condition as it is ascertained at the drilling fluid analyzers. The signal of the drilling fluid analyzer can be relayed each time to one or more units of the system. In particular, the signal of a drilling fluid analyzer will be relayed to the following unit—in terms of the fluid movement.

The invention also creates a method for providing a drilling fluid for earth drilling, wherein the drilling fluid comprises a liquid and at least one mineral. The method involves the step of recycling of supplied drilling fluid coming from the earth borehole created. According to the invention, it is provided to determine the state of the drilling fluid before and/or after the recycling, and to perform the mixing of the recycled drilling fluid with liquid and/or mineral according to the ascertained state of the drilling fluid. In this way, a drilling fluid can be used which is adapted to the requirements of the earth borehole being created. The spent drilling fluid can be reconditioned and supplied to the borehole for its production and further advancement.

In one preferred embodiment, the method also involves the step of determining the state of the drilling fluid before and after the recycling, so that a greater variability and especially also a verification of the state of the drilling fluid.

In one preferred embodiment, the method involves a wireless transmission of a signal corresponding to the ascertained state of the drilling fluid, by which a high variability can be achieved. A physically present conduit cable for the transmission of a signal is unnecessary. It may be provided that the components belonging to the system communicate with each other unidirectionally or bidirectionally. By means of a bidirectional communication, an adjustment can be created and/or a response can be sent that at least one signal has been received for the condition of the drilling fluid. It may also be provided that a signal transmission is done in a bidirectional communication which indicates the settings of the recycling device, the mixing device and/or the ground drilling device with regard to the drilling fluid or the mixing or the creating of the borehole.

An adaptation to different circumstances can be accomplished. For different circumstances, a predetermined setpoint can be achieved, i.e., a predetermined target condition of the drilling fluid. The setpoint or the target condition of the drilling fluid may be chosen as a function of the ground or soil and/or the ground drilling device being used. In this way, a good adaptation of the drilling fluid to the circumstances is possible.

In one preferred embodiment, the signal indicating the setpoint for the condition of the drilling fluid is transmitted from the ground drilling device. In this way, the ground drilling device can become involved in the method for preparing of drilling fluid for the earth drilling. The conditions which are set at the ground drilling device or ascertained in it (parameters for the producing of the boring) can be used in determining the setpoint for the condition of the drilling fluid. For example, the advancement achieved with the ground drilling device can be determined at the ground drilling device and this advancement can also be used to infer the condition of the soil in which the earth drilling is taking place. The drilling fluid can be adapted to this by selecting a corresponding setpoint for the condition of the drilling fluid.

The invention also creates a use of a system for providing a drilling fluid for earth drilling. The drilling fluid comprises a liquid and at least one mineral. The system comprises a recycling device for preconditioning of supplied drilling fluid. At least one drilling fluid analyzer is used to determine the state of drilling fluid, which is coupled to a mixing device for the mixing of drilling fluid reconditioned by the recycling device with liquid and/or mineral, in order to perform mixing according to the state of the drilling fluid.

Regarding the aspect of the use of the system, the system may be designed as described above. All embodiments mentioned in regard to the aspect of the system may also be embodiments of how the system may be designed in the use according to the invention.

The preceding remarks, just as the following description of exemplary embodiments, do not constitute any abandonment of particular embodiments or features.

The invention shall now be explained more closely with the aid of exemplary embodiments presented in the drawing.

The single FIGURE of the application shows schematically a system according to the invention for providing of drilling fluid for the earth drilling.

FIG. 1 shows in a schematic representation how a drilling fluid is prepared for the earth drilling. FIG. 1 represents a system comprising a ground drilling device 1, a recycling device 2, a mixing device 3 and several drilling fluid analyzers 4, 5, 6.

With the ground drilling device 1, an (earth) borehole 7 is produced with the aid of a drilling fluid. The drilling fluid used for the drilling of the earth borehole 7 is recovered and its condition is ascertained by means of a drilling fluid analyzer 4. For this, a sensor of the drilling fluid analyzer 4 can be arranged in a conduit 8 carrying the (spent) drilling fluid used for the earth drilling. Depending on the condition as ascertained by the drilling fluid analyzer 4, a signal is sent, coordinated with the particular condition. For the transmission of the signal, the drilling fluid analyzer 4 has a transmitter, so that the transmission of the signal is wireless.

The drilling fluid used for the earth borehole 7 is taken to the recycling device 2. For this, the conduit 8 is provided between the earth borehole 7 and the recycling device 2, in which the sensor of the drilling fluid analyzer 4 is also arranged. The recycling device 2 has at least one receiver, which can receive a signal in wireless manner. In particular, the recycling device 2 can receive the signal of the drilling fluid analyzer 4 in order to take steps for reconditioning the drilling fluid. Thus, the reconditioning can be adjusted with the recycling device 2 according to the condition of the drilling fluid in the conduit 8 as determined by the drilling fluid analyzer 4.

The drilling fluid reconditioned by the recycling device 2 is taken to the mixing device 3, for which a conduit 9 is used. In the conduit 9 there is situated a sensor of the drilling fluid analyzer 5, in order to ascertain the condition of the drilling fluid as present after the reconditioning by the recycling device 2. The drilling fluid analyzer 5 has a transmitter which sends a signal in dependence on the condition of the drilling fluid.

The mixing device 3 has a receiver, which can receive a signal relayed wirelessly. In particular, the signals of the drilling fluid analyzer 4 and most particularly 5 can be used in order to mix the drilling fluid reconditioned by the recycling device 2 with liquid and/or mineral in the mixing device 3. The mixing device 3 is coupled with the drilling fluid analyzers 4 and/or 5 in order to mix the drilling fluid according to its condition. The mixing device 3 is connected by means of a conduit 10 to the ground drilling device 1 in order to supply newly mixed drilling fluid to the ground drilling device 1. In the conduit 10 is arranged a sensor of the drilling fluid analyzer 6 in order to ascertain the condition of the drilling fluid as it is provided by the mixing device 3. The drilling fluid analyzer 6 also has an antenna with which signals can be transmitted wirelessly.

The ground drilling device 1 has a unit for sending signals wirelessly. The unit can operate as a transmitter and a receiver. The unit can receive signals from the drilling fluid analyzer 6 that indicate the condition of the drilling fluid as supplied to the ground drilling device 1, in order to adapt the settings for the earth drilling. But the unit can also be used for sending of signals in order to send signals to the recycling device 2 and/or the mixing device 3 as to how the earth borehole 7 should be produced, i.e., which parameters should be used in the ground drilling device 1. For example, by means of the parameters used it is possible to infer the soil in which the earth borehole 7 is being produced. In this way, it is possible to respond to the requirements for the drilling fluid in particular soils.

A control unit 11, which in the exemplary embodiment shown is arranged at the ground drilling device 1, can receive the signals and actuate the recycling device 2 and/or the mixing device 3 by means of signals sent.

The invention claimed is:

1. A system for providing a drilling fluid for earth drilling, wherein the drilling fluid comprises a liquid and at least one mineral, comprising:

a first drilling fluid analyzer for determining a condition of drilling fluid that comes out of a drilled borehole, the first drilling fluid analyzer comprising a first sensor configured to determine one or more physical or chemical quantities of the borehole supplied drilling fluid indicative of a determined condition of said drilling fluid, a recycling device for fluidly connected to the drilled borehole via a conduit conveying said borehole supplied drilling fluid, wherein said recycling device is configured to receive a signal indicative of the determined condition of drilling fluid and to employ one or more filters to perform filtering operations to separate said borehole supplied drilling fluid into components useful for downstream mixing according to a target condition, thereby providing reconditioned drilling fluid;

a mixing device positioned downstream of said recycling device and fluidly coupled thereto and having a chamber or channel for mixing the reconditioned drilling fluid reconditioned by the recycling device with liquid and/or mineral, wherein the mixing device is coupled to the drilling fluid analyzer in order to perform mixing according to the determined condition of the drilling fluid by matching the determined condition of the drilling fluid with a setpoint value of valves of the mixing device configured to achieve the target condition.

2. The system according to claim 1, further comprising a control unit coupled to the drilling fluid analyzer and with which the mixing device can be actuated to provide a particular condition.

3. The system according to claim 1, further comprising a second conduit which fluidly connects the recycling device and the mixing device, and wherein a sensor of said first drilling fluid analyzer is arranged in the conduit.

4. The system according to claim 3, wherein a second drilling fluid analyzer is disposed in the second conduit between said recycling device and said mixing device for determining the state of the reconditioned drilling fluid that comes out of the recycling device, the second drilling fluid analyzer comprising a second sensor configured to determine one or more physical or chemical quantities of the reconditioned drilling fluid indicative of a condition of said reconditioned drilling fluid, and wherein the mixing device is coupled to the second drilling fluid analyzer for adjusting mixing of the reconditioned drilling fluid from the recycling device, and said one liquid and/or mineral, according to a signal output from said second drilling fluid analyzer corresponding to the determined condition of the reconditioned drilling fluid by matching the determined condition of the reconditioned drilling fluid with a setpoint value of valves of the mixing device configured to achieve the target condition.

5. The system according to claim 4, further comprising:

a third drilling fluid analyzer in line between said mixing device and a ground drilling device downstream of said mixing device for determining the state of the drilling fluid that comes out of the mixing device, the third drilling fluid analyzer comprising: a third sensor configured to determine one or more physical or chemical quantities of the drilling fluid from the mixing device indicative of a determined condition of said drilling fluid output from the mixing device, and a transmitter for transmitting a signal indicative of the determined condition of said drilling fluid output from the mixing device;

wherein the ground drilling device coupled to the third drilling fluid analyzer comprises a receiver for receiving the signal transmitted from the third drilling fluid analyzer, the ground drilling device adjusting one or more parameter settings for the earth drilling according to said received signal.

6. The system according to claim 1, wherein the first drilling fluid analyzer is wirelessly connected to the recycling device and the mixing device.

7. The system according to claim 1, wherein said filtering operations comprise at least one of a mechanical filtering, a chemical separation, and rejection of portions of the drilling fluid coming from the borehole.

8. The system according to claim 1, wherein said first drilling fluid analyzer is further configured to determine a given soil condition based on the borehole drilling fluid and send a signal to the mixing device to adjust the condition of the drilling fluid to the given soil in which the drilling head of the ground drilling device resides.

9. A method for providing a drilling fluid for earth drilling, wherein the drilling fluid comprises a liquid and at least one mineral, the method comprising:

recycling spent drilling fluid from a drilled borehole by determining using a sensor one or more physical or chemical quantities of the borehole supplied drilling fluid indicative of a determined condition of said spent drilling fluid, and transmitting a signal associated with said determined condition;

automatically conveying said spent drilling fluid to a recycling device;

performing at said recycling device select filtering operations according to said signal to separate said borehole supplied drilling fluid into components useful for downstream mixing based on a target condition, and mixing of the recycled drilling fluid with liquid and/or mineral according to the signal associated with said determined condition of the drilling fluid by matching the determined condition of the drilling fluid with a setpoint value of valves of a mixing device configured to achieve the target condition.

10. The method according to claim 9, further comprising:

determining using a second sensor in line with the flow of drilling fluid from the recycling device, to a mixing device, one or more physical or chemical quantities of the recycling device indicative of a determined condition of said recycling device drilling fluid; and adjusting mixing of the reconditioned drilling fluid from the recycling device, and said one liquid and/or mineral, according to a signal corresponding to the determined condition of the reconditioned drilling fluid from said second sensor, by matching the determined condition of the reconditioned drilling fluid with a setpoint value of valves of the mixing device configured to achieve the target condition.

11. The method according to claim 9, further comprising wireless transmission of a signal corresponding to the determined condition of the drilling fluid.

12. The method according to claim 9, further comprising transmission of a signal corresponding to a setpoint from a ground drilling device.

13. The method of claim 9, wherein the one or more physical or chemical quantities comprise density, viscosity, sand content, and chemical composition of the spent drilling fluid.

14. A system for providing a drilling fluid for earth drilling, wherein the drilling fluid comprises a liquid and at least one mineral, comprising:

a first drilling fluid analyzer for determining a condition of drilling fluid that is supplied out of a drilled borehole, the first drilling fluid analyzer comprising a first sensor configured to determine one or more physical or chemical quantities of the borehole supplied drilling fluid indicative of a given condition of said drilling fluid, and a transmitter configured to transmit a signal corresponding to said given condition;

a recycling device for reconditioning said borehole supplied drilling fluid, the recycling device fluidly connected to the drilled borehole to receive said borehole supplied drilling fluid, wherein said recycling device includes a receiver for receiving said transmitted signal from said first drilling fluid analyzer, and performs filtering operations based on said given condition relative to a target condition, to thereby provide a reconditioned drilling fluid;

a second drilling fluid analyzer disposed in line between said recycling device and a mixing device disposed downstream of said recycling device, for determining a state of the reconditioned drilling fluid that comes out of the recycling device, the second drilling fluid analyzer comprising a second sensor configured to determine one or more physical or chemical quantities of the reconditioned drilling fluid indicative of a given condition of said reconditioned drilling fluid, and a transmitter configured to transmit a signal corresponding to said given reconditioned fluid condition;

wherein said mixing device includes a chamber or channel for mixing the reconditioned drilling fluid reconditioned by the recycling device with liquid and/or mineral, and wherein the mixing device includes a receiver for receiving at least one of the signals from the first and second drilling fluid analyzers, the mixing device performing mixing of the reconditioned drilling fluid with said liquid and/or mineral in amounts according to the at least one of the determined conditions from the at least one of the signals from the first and second drilling fluid analyzers by matching the at least one of the determined conditions of the drilling fluid with a setpoint value of valves of a mixing device in order to achieve the target condition.

15. The system of claim 14, wherein the first and second drilling fluid analyzers determine the density, viscosity, sand content, and chemical composition of the respective borehole and reconditioned drilling fluids.

16. The system of claim 14, wherein the first and second signals corresponding to the conditions determined from the first and second drilling fluid analyzers are received by the mixing device and used to match the determined condition of the drilling fluid with a setpoint value of valves of the mixing device configured to achieve the target condition.

* * * * *